US006260592B1

(12) United States Patent
Lindholm

(10) Patent No.: US 6,260,592 B1
(45) Date of Patent: Jul. 17, 2001

(54) CUTTING PIECE AND CUTTING ARM FOR A DEBARKING MACHINE OF A HOLLOW-ROTOR TYPE

(75) Inventor: Holger Lindholm, Lohja (FI)

(73) Assignee: Valon Kone Oy, Lokja (FI)

( * ) Notice: Subject to any disclaimer, the term of this patent is extended or adjusted under 35 U.S.C. 154(b) by 0 days.

(21) Appl. No.: 09/319,514

(22) PCT Filed: Jun. 19, 1996

(86) PCT No.: PCT/FI96/00356

§ 371 Date: Dec. 22, 1997

§ 102(e) Date: Dec. 22, 1997

(87) PCT Pub. No.: WO97/00762

PCT Pub. Date: Jan. 9, 1997

(30) Foreign Application Priority Data

Jun. 22, 1995 (FI) ..... 953150

(51) Int. Cl.[7] ..... B27L 1/00; B27C 5/00

(52) U.S. Cl. ..... 144/208.8; 144/208.1; 144/241; 403/408.1; 407/48; 407/114

(58) Field of Search ..... 144/208.1, 208.8, 144/218, 241; 403/373, 408.1; 407/46, 47, 103, 114

(56) References Cited

U.S. PATENT DOCUMENTS

| | | | | |
|---|---|---|---|---|
| 4,209,047 | | 6/1980 | Weill . | |
| 4,384,600 | * | 5/1983 | Kivimaa | 144/241 |
| 4,653,559 | * | 3/1987 | Ackerman | 144/241 |
| 4,709,737 | | 12/1987 | Jonsson . | |
| 5,460,212 | * | 10/1995 | Darden | 144/241 |

FOREIGN PATENT DOCUMENTS

| | | |
|---|---|---|
| 811965 | 6/1981 | (FI) . |
| 823822 | 11/1982 | (FI) . |
| 72457 | 2/1987 | (FI) . |
| 84703 | 9/1991 | (FI) . |
| 430 391 | 11/1983 | (SE) . |
| 463 660 | 1/1991 | (SE) . |
| WO 97/04930 | 2/1997 | (WO) . |

* cited by examiner

*Primary Examiner*—W Donald Bray
(74) *Attorney, Agent, or Firm*—Burns, Doane, Swecker & Mathis, L.L.P.

(57) ABSTRACT

A replaceable cutting piece and a cutting arm for a debarking cutter for a debarking machine of a hollow-rotor type, which cutting piece (6) and cutting arm (4) comprise supporting surfaces and abutment surfaces for receiving loads acting on the cutting piece fastened by a retaining screw to a housing (7) formed in the cutting arm. In order to direct the loads acting on the cutting piece in full to the cutting arm instead of to the retaining screw, the cutting piece and the cutting arm comprise supporting surfaces and abutment surfaces (9*a* to 9*d*, 11*a*, 11*b*, 12*a*, 14*a*, 14*b*) for receiving the loads acting on the cutting piece in the direction of the axle, the radius and the tangent of the rotor and the torque caused by said loads, which surfaces are situated in perpendicular planes with respect to one another.

8 Claims, 2 Drawing Sheets

FIG. 1
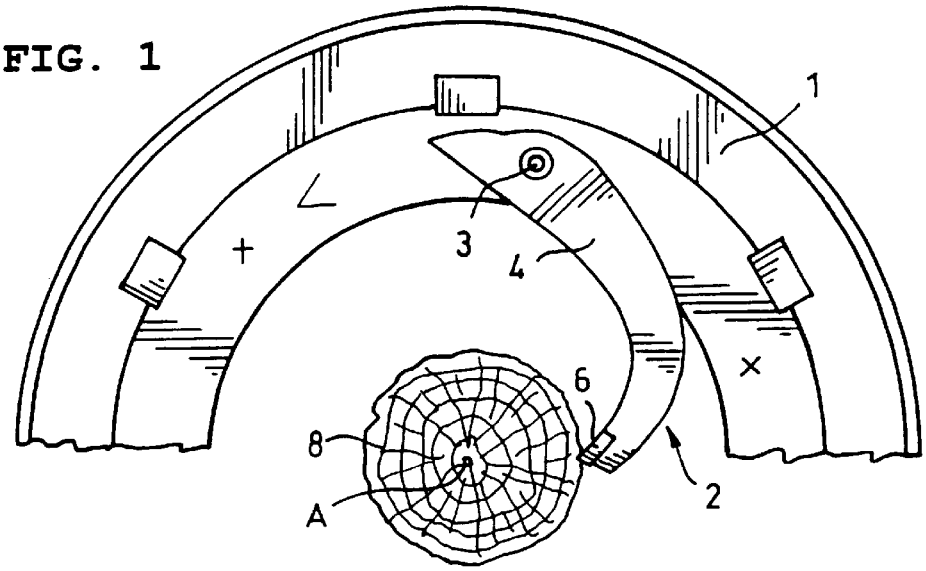
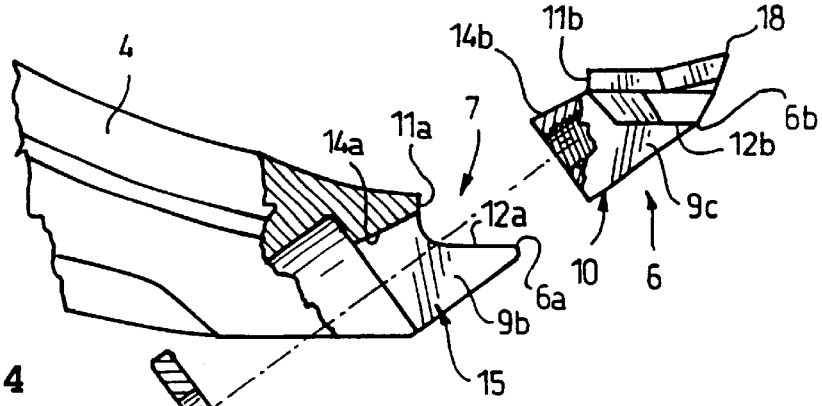
FIG. 4
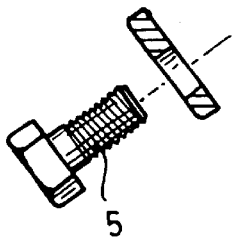
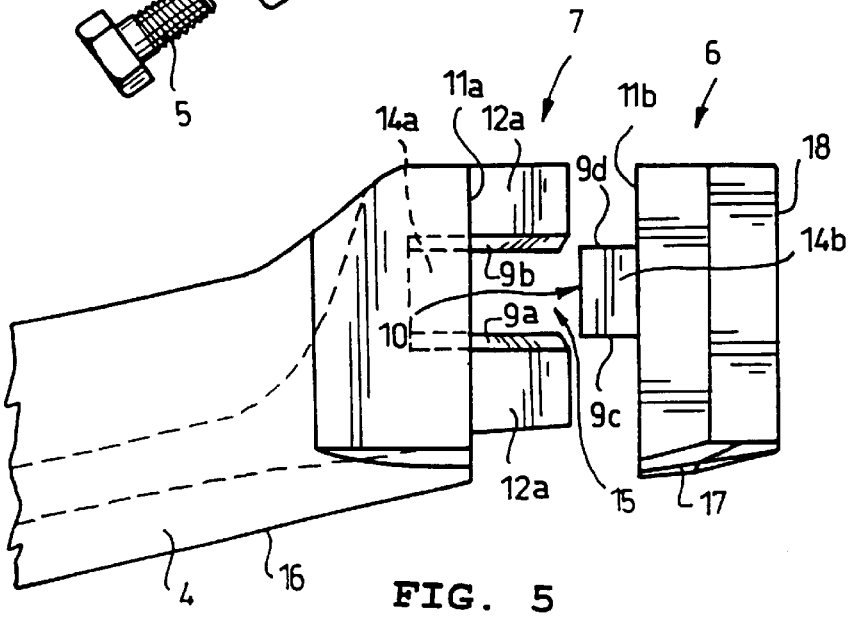
FIG. 5

FIG. 2
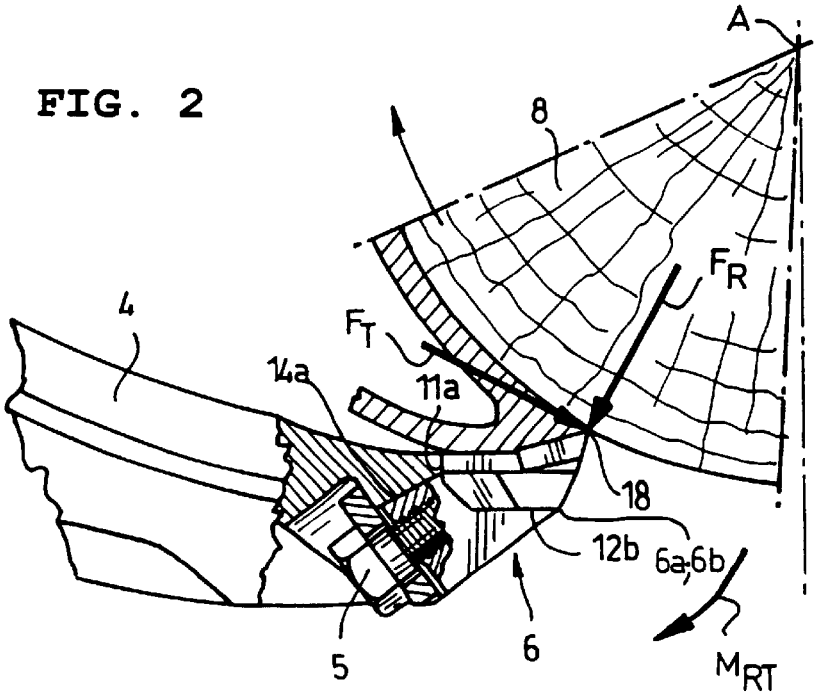
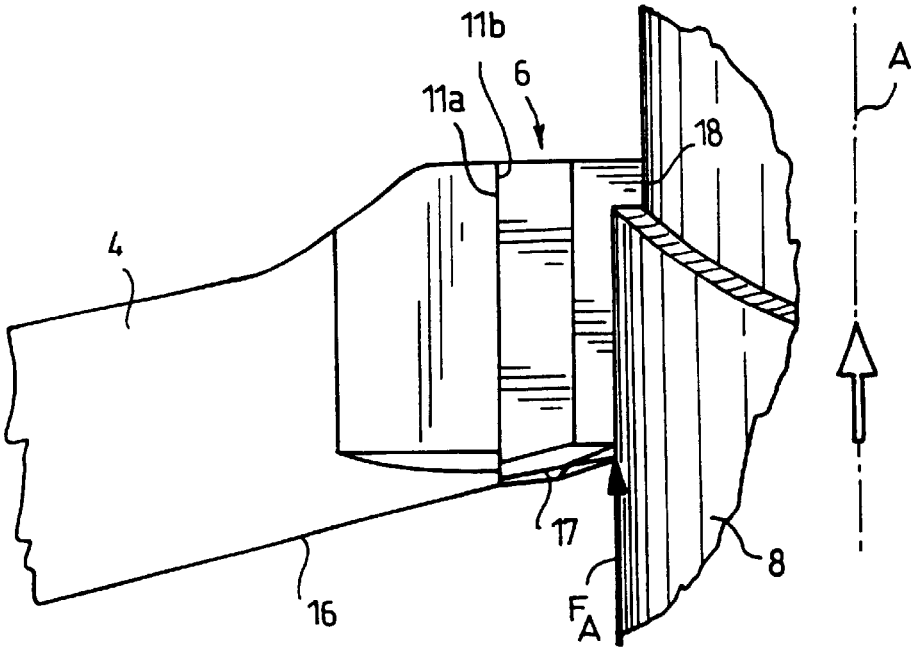
FIG. 3

CUTTING PIECE AND CUTTING ARM FOR A DEBARKING MACHINE OF A HOLLOW-ROTOR TYPE

The present invention relates to a replaceable cutting piece for a debarking cutter for a debarking machine of a hollow-rotor type for debarking a log to be fed axially through a rotor, which cutting piece comprises a cutter forming a cutting edge and a projection protruding from the cutter, said cutter and projection forming supporting surfaces for receiving loads acting on the cutting piece during debarking, and means for securing the cutting piece to a cutting arm of the debarking cutter by the supporting surfaces of the cutting piece.

The main regulating units of a debarking machine comprise a rotor carrying out the debarking, debarking cutters supported by the rotor and feeding devices both in front of and at the rear of the rotor that guide the tree to be debarked to the centre of the rotor and feed it through the rotor.

The rotor of a debarking machine comprises a rotating drum through which the tree to be debarked is fed. The debarking cutters are secured to this rotating drum each on a shaft acting as a pivot, which cutters in a position of rest are directed towards the centre of the rotor in such a manner that when rotating, the cutting edges of the debarking cutters form a circle corresponding to the smallest diameter of a tree to be debarked with the machine. The cutting edges of the debarking cutters are pressed against the surface of the tree to be debarked by the action of a spring mechanism built inside the drum of the rotor. This spring mechanism keeps the debarking cutters closed towards their minimum opening when no tree is fed through the rotor.

The tree to be debarked is centralized by means of the feeding devices of the debarking machine to the centre of the rotor and is fed into the opening of the drum of the rotor. The end of the tree contacts the cutting arm of the debarking cutters which are in a closed position and rotate with the rotor in an area equal to the diameter of the tree.

Because of the rotating motion of the rotor and the effect of a lifting edge on the cutting arm in a closed position, the cutting piece secured to the cutting arm turns up on the surface of the tree to be debarked. The debarking takes places in such a manner that the lifting edge and the cutting edge of the cutting piece cut and remove the bark as a spiral-shaped cutting in accordance with the advancing movement of the tree.

Known rotor debarking machines primarily use two types of debarking cutters.

A basic debarking cutter comprises a cutting arm in which a lifting edge and a cutting edge are shaped. Today the use of these kinds of cutter solutions is being discontinued as when debarking different types of trees, for example, series of debarking cutters are needed for each kind of tree and for each debarking condition. Further, the maintenance of the debarking series is difficult because big, heavy objects must be handled.

For practical reasons, debarking cutter constructions for rotor debarking machines have increasingly been replaced by types that comprise a cutting arm and a replaceable cutting piece attached thereto. In that case, when the tree type or the conditions change, only the cutting pieces carrying out the debarking need be replaced. Also, the quality of debarking can be maintained in a considerably simpler way as maintenance procedures have to be made only on cutting pieces of a minimal weight, while the cutting arm used is the same in all conditions.

In known cutting piece solutions, e.g. Finnish Patents 72,457 and 84,703, the cutting piece is fastened by means of a screw on a planar abutment surface in the cutting arm, the cutting piece leaning onto the abutment surface on a corresponding supporting surface. In that case, some of the debarking forces produced during debarking will strain the retaining screws. In some solutions, attempts have been made to reduce the loads acting on the retaining screw by forming the abutment plane into a shallow conical shape or by using different kinds of recesses in the abutment plane, whereby the cutting piece has a protrusion that fits into a corresponding recess in the cutting arm, e.g. U.S. Pat. No. 4,709,737. In known solutions, the retaining screws of the cutting piece will always have to receive a significant portion of the debarking forces.

The object of the present invention is to achieve a replaceable cutting piece that will avoid the drawbacks mentioned above and will enable the loads acting on the cutting piece to be transmitted in full to the cutting arm instead of to the retaining screw.

This object is achieved with a cutting piece according to the invention, which is characterized in that the cutting piece comprises

- at least one first supporting surface receiving a load acting on the cutting piece in an axial direction of the rotor,
- at least one second supporting surface receiving a load acting on the cutting piece in a radial direction of the rotor, said second supporting surface being situated in a perpendicular plane with respect to the first supporting surface,
- at least one third supporting surface receiving a load acting on the cutting piece in a tangential direction of the rotor, said third supporting surface being situated in a perpendicular plane with respect to the first and the second supporting surfaces, and
- at least one fourth supporting surface receiving a torque acting on the cutting piece due to the load acting in the radial direction of the rotor and the load in the tangential direction of the rotor, said fourth supporting surface being situated in the projection of the cutting piece.

In accordance with the invention, the cutting piece can be positioned in the cutting arm so that the loads caused by debarking can be controlled by supporting surfaces formed in the cutting piece and by corresponding abutment surfaces formed in the cutting arm. When the loads caused by debarking can be controlled as shown above between the cutting arm and the cutting piece by means of surfaces in contact with one another, the only task remaining for the retaining screws is to position the cutting piece into the right position in the cutting arm. Thereby debarking forces acting on the screw can be avoided.

The object of this invention is also to obtain a cutting arm for a debarking cutter of a debarking machine of the hollow-rotor type with which the advantages mentioned in connection with the cutting piece are attained. This object is achieved by a cutting arm which is characterized by what is disclosed in the characterizing part of claim 5.

In the following, the invention will be explained in more detail with reference to the attached drawings, in which FIG. 1 shows a schematic axial view of a rotor of a debarking machine provided with debarking cutters, FIGS. 2 and 3 show enlarged views of a cutting arm of a debarking cutter provided with cutting pieces in a debarking position in the axial direction of the rotor and in the tangential direction of the rotor, respectively, and FIGS. 4 and 5 show the cutting arm and, respectively, the cutting piece detached from one another.

FIG. 1 of the drawings discloses a hollow rotor 1 of a debarking machine mounted in bearings onto a frame (not shown) rotatably around a central axis A of the rotor. A group of debarking cutters 2 is mounted onto the rotor pivotably on axle shafts 3 extending in the direction of the axle. The debarking cutters are forced by springs to pivot towards the axle of the rotor.

The debarking cutter comprises a cutting arm 4 and a cutting piece 6 having a cutter 6' and the cutting piece is fastened to the free end (inner end) of the cutting arm by a screw 5. A housing 7 for the cutting piece is formed in the cutting arm.

FIGS. 2 and 3 of the drawings show main forces $F_A$, $F_R$ and $F_T$ which act on the cutting piece during debarking and which the attachment and the construction connecting the cutting arm and the cutting piece must sustain.

The direction of the load $F_A$ in the feeding direction of a log 8, that is, in the direction of the axle A of the rotor can in practice vary due to the unevenness of the surface of the tree, the quality of the delimbing operation etc. The loads caused by the force $F_A$ are received by abutment surfaces 9*a* and 9*b* formed by a notch 15 made in the housing in the cutting arm, and by corresponding surfaces 9*c* and 9*d* of a projection 10 provided in the cutting piece and positioned in close contact with the abutment surfaces:

The load $F_R$ in the direction of the radius of the rotor is dependent on the kind of wood used at each time and on the actual cutting pressure. The loads caused by the force $F_R$ are received by abutment surfaces 11*a* and 12*a* formed in the housing and supporting surfaces 11*b* and 12*b* in the cutting piece.

The load $F_T$ in the direction of the tangent of the rotor is dependent on the characteristics of the bark, as well as on the size of formations differing from the circular form of the tree and the size of branch remains. The loads caused by the forces $F_T$ are received by the abutment surface 12*a* formed in the housing and by the corresponding supporting surface 12*b* in the cutting piece. Furthermore, the torque $M_{RT}$ caused by the load $F_T$ around a tip 6*a* of the abutment surface 12*a* and a tip 6*b* of the supporting surface 12*b* of the cutting piece is received as a pressure between an abutment surface 14*a* made in the housing and a supporting surface 14*b* made in the cutting piece.

In this embodiment, all supporting surfaces and abutment surfaces cut into the cutting arm and the cutting piece are even planes. The supporting surfaces 9*c* and 9*d* are cut on opposite sides of the projection 10 in the cutting piece and the abutment surfaces 9*a* and 9*b* are cut on opposite sides of the notch 15 formed in the cutting arm. The supporting surface 14*b* is cut into the projection of the cutting piece between the supporting surfaces 9*c* and 9*d* and the abutment surface 14*a* is cut into the notch formed in the cutting arm between the abutment surfaces 9*a* and 9*b*. The projection fits wedgelike into the notch 15. The cutting piece is secured in place by the screw 5 in such a manner that said supporting surfaces and abutment surfaces are pressed against each other.

The tree fed into the rotor contacts a cutting arm in a closed position, whereby the cutting piece rises to the surface of the tree by the effect of the rotating motion and a lifting edge 16 in the cutting arm and a lifting edge 17 in the cutting piece.

Debarking takes place as the tree advances in such a manner that the lifting edge of the cutting piece cuts the bark into strips and the cutting piece penetrates between the tree and the bark by the effect of pressing force of the spring in such a manner that a cutting edge 18 travels along the surface of the tree and the cutting piece scrapes off the bark ahead.

In the attachment of the cutting piece according to the invention all loads produced by debarking are received by supporting surfaces and abutment surfaces between the cutting piece and the cutter arm and the retaining screw only has to keep the cutting piece in place in the housing of the cutter arm.

The drawing and the description related to it are only intended to illustrate the idea of the invention. In their details, the cutting piece and the cutting arm according to the invention may vary within the scope of the claims.

What is claimed is:

1. A replaceable cutting piece for a debarking cutter for a debarking machine of a hollow-rotor type for debarking a log (8) to be fed axially through a rotor (1), which cutting piece (6) comprises a cutter (6') forming a cutting edge (18) and a projection (10) protruding from the cutter, said cutter and projection forming supporting surfaces for receiving loads acting on the cutting piece during debarking, and means (5) for securing the cutting piece to a cutting arm (4) of the debarking cutter by the supporting surfaces of the cutting piece, characterized in that the cutting piece comprises at least one first supporting surface (9*c*, 9*d*) receiving a load ($F_A$) acting on the cutting piece in an axial direction of the rotor, at least one second supporting surface (11*b*) receiving a load ($F_R$) acting on the cutting piece in a radial direction of the rotor, said second supporting surface being situated in a perpendicular plane with respect to the first supporting surface, at least one third supporting surface (12*b*) receiving a load ($F_T$) acting on the cutting piece in a tangential direction of the rotor, said third supporting surface being situated in a perpendicular plane with respect to the first and the second supporting surfaces, and at least one fourth supporting surface (14*b*) receiving a torque ($M_{RT}$) acting on the cutting piece due to the load ($F_R$) acting in the radial direction of the rotor and the load ($F_T$) in the tangential direction of the rotor, said fourth supporting surface being situated in the projection (10) of the cutting piece.

2. A cutting piece according to claim 1, characterized in that the first and the second supporting surfaces (9*c*, 9*d*, 11*b*) are situated in essentially perpendicular planes with respect to one another.

3. A cutting piece according to claim 1, characterized in that the first supporting surface (9*c*, 9*d*) and the fourth supporting surface (14*b*) are situated in said projection (10).

4. A cutting piece according to claim 3, characterized in that the first supporting surfaces (9*c*, 9*d*) are situated on opposite sides of the projection (10) of the cutting piece (6).

5. A cutting arm for a debarking cutter for a debarking machine of a hollow-rotor type which cutting arm (4) is formed to be mounted pivotably on a rotor (1) of the debarking machine and is provided at one end with a housing (7) for a replaceable cutting piece (6), which housing has a notch (15) for receiving a projection (10) provided on the cutting piece and abutment surfaces for said cutting piece, characterized in that the housing of the cutting arm comprises at least one first abutment surface (9*a*, 9*b*) for receiving a load ($F_A$) acting on the cutting arm through the cutting piece in an axial direction of the rotor, at least one second abutment surface (11*a*) for receiving a load ($F_R$) acting on the cutting arm through the cutting piece in a radial direction of the rotor, said second abutment surface being situated in a perpendicular plane with respect to the first abutment surface, at least one third abutment surface (12*a*) for receiving a load ($F_T$) acting on the cutting arm through the cutting piece in a tangential direction of the rotor, said third abutment surface being situated in a perpendicular plane with respect to the first and the second abutment surfaces, and at least one fourth abutment surface (14*a*) for receiving a torque ($M_{RT}$) acting on the cutting arm through the cutting piece due to the load ($F_R$) in the radial direction of the rotor and the load ($F_T$) in the tangential direction of the rotor, said fourth abutment surface being situated in the notch (15) of the cutting arm.

6. A cutting arm according to claim 5, characterized in that the first and the second abutment surfaces (9*a,* 9*b,* 11*a,* 12*a*) are situated in essentially perpendicular planes with respect to one another.

7. A cutting arm according to claim 5, characterized in that the first and the fourth abutment surfaces (9*a,* 9*b,* 14*a*) are situated in said notch (15).

8. A cutting arm according to claim 7, characterized in that the first abutment surfaces (9*a,* 9*b*) are situated on opposite sides of the notch (15) of the cutting arm (4).

* * * * *